US006834789B1

(12) United States Patent
Dion et al.

(10) Patent No.: US 6,834,789 B1
(45) Date of Patent: Dec. 28, 2004

(54) PNEUMATIC FASTENER DRIVING TOOL FOR HARDWOOD FLOORING

(75) Inventors: Marc Dion, St-Augustin-de-Desmaures (CA); Jacques Maltais, Beauport (CA)

(73) Assignee: Laboratoire Primatech Inc., Quebec (CA)

( * ) Notice: Subject to any disclaimer, the term of this patent is extended or adjusted under 35 U.S.C. 154(b) by 0 days.

(21) Appl. No.: 10/807,106

(22) Filed: Mar. 24, 2004

(51) Int. Cl.[7] ..... B25C 1/04
(52) U.S. Cl. ..... 227/148; 227/130
(58) Field of Search ..... 227/8, 130, 127, 227/148, 147

(56) References Cited

U.S. PATENT DOCUMENTS

| | | | | | |
|---|---|---|---|---|---|
| 2,733,440 | A | | 2/1956 | Jenny | |
| 2,874,383 | A | | 2/1959 | Wieneke | |
| 3,051,135 | A | * | 8/1962 | Smith | 91/169 |
| 3,281,046 | A | | 10/1966 | Boulay | |
| 3,542,273 | A | | 11/1970 | Hedrick | |
| 3,595,460 | A | | 7/1971 | Pitkin | |
| 4,196,833 | A | * | 4/1980 | Haytayan | 227/8 |
| 4,346,831 | A | * | 8/1982 | Haytayan | 227/8 |
| 4,597,517 | A | | 7/1986 | Wagdy | |
| 4,671,443 | A | | 6/1987 | Becht | |
| 4,907,730 | A | | 3/1990 | Dion | |
| 5,205,457 | A | | 4/1993 | Blomquist, Jr. | |
| 5,485,946 | A | * | 1/1996 | Jankel | 227/8 |
| 5,645,208 | A | * | 7/1997 | Haytayan | 227/8 |
| 5,850,961 | A | * | 12/1998 | Braun et al. | 227/130 |
| 6,095,392 | A | * | 8/2000 | Batts et al. | 227/8 |
| 6,155,472 | A | | 12/2000 | Deziel | |
| 6,220,496 | B1 | * | 4/2001 | Hirai et al. | 227/130 |

* cited by examiner

*Primary Examiner*—Scott A. Smith
(74) *Attorney, Agent, or Firm*—Francois Martineau

(57) ABSTRACT

A pneumatic mallet-blow operated fastener driving tool for securing hardwood planks to a subfloor, which comprises a fastener discharge mechanism in turn comprising a housing having a pressurized main chamber in direct link with a compressed air intake, a selectively depressurizable closure chamber pressurized when the tool is at rest, and a cylinder in which a piston having a plunger affixed thereto is slidably mounted. A valve, biased toward a closed position when the closure chamber is pressurized, or biased towards its open limit position if the closure chamber is depressurized, permits selective establishment of fluid communication between the inside of the cylinder and the pressurized main chamber. The piston, at a retracted limit position when the tool is at rest, is forced towards a deployed limit position when fluid communication is established between the main chamber and the inside of the cylinder, in order for its plunger to strike a fastener and drive it into an underlying plank. In use, after the mallet blow has engendered depressurizing of the closure chamber, the valve is moved in its open limit position, a fastener is discharged from the tool upon being struck by deployment of the piston by being struck by its plunger, and closure chamber starts to become pressurized again by compressed fluid flowing therein from the main chamber through a first fluid inlet, which initiates movement of the valve towards its closed position, and after such movement is initiated, a second fluid inlet port opens up to further admit compressed air into the closure chamber and thus accelerate pressurizing of the closure chamber and displacement of the valve towards its closed position.

20 Claims, 12 Drawing Sheets

PNEUMATIC FASTENER DRIVING TOOL FOR HARDWOOD FLOORING

FIELD OF THE INVENTION

The present invention relates to pneumatic fastener driving devices, and more particularly to a compressed air operated and impact blow triggered fastener driving tool for anchoring hardwood planks to a subfloor.

BACKGROUND OF THE INVENTION

Hardwood flooring generally consists of a number of elongated narrow tongue-and-groove planks individually fitted close to one another and then fastened in position to a subjacent subfloor. To fasten these hardwood planks to the subfloor of a room composed for example of plywood plates or floor joists, it is known to use pneumatic mallet-operated fastener driving tools. Such fastener driving tools generally comprise a main body with a floor-engageable slider shoe mounted to its bottom surface, upon which the tool rests against a hardwood plank prior to discharging a fastener in the latter, this shoe having a usually right-angle step-shaped indentation made thereon. These fastener driving tools also comprise a magazine holding fasteners in the form of metallic L- or T-shaped barbed cleats, and feeding them to a pneumatic fastener discharge mechanism, activated when a mallet strikes an impact-receiving member thereof. The fastener discharge mechanism comprises a number of pneumatically distinct chambers and mobile parts, and these mobile parts can be actuated upon occurrence of air pressure differences between corresponding chambers.

To fasten a hardwood plank to the floor, a workman has to lay the fastener driving tool onto a hardwood plank, such that the 90° indentation made on its shoe engages the angular edge of the hardwood plank, and then uses a mallet to strike the impact-receiving member of the fastener discharge mechanism which causes the tool to discharge a cleat and forcibly drive the latter transversely through the hardwood plank, and into the subfloor.

In prior art tools of this type, movement synchronisation between all mobile parts within the fastener discharge mechanism lacks optimization, which results in a slower reload speed of the tool. Furthermore, actual pneumatic flooring tools consume excessive quantities of compressed air. Also, the hammer striking head of the tool being usually bolted to the tool main housing, access to internal parts is more time consuming.

OBJECTS OF THE INVENTION

An object of the invention is to improve upon U.S. Pat. No. 4,907,730 issued Mar. 13, 1990.

An object of this invention is to facilitate access by the pneumatic tool to floor areas close to vertical walls for driving fasteners adjacent thereto.

Another object of the invention is to improve upon reload speed of the pneumatic tool.

A further object of the invention is to reduce labour costs and reducing maintenance time by facilitating fast and easy access via the screwable impact receiving member to the tool internal wear part components.

A general object of this invention is to provide a pneumatic nailer of smaller size, to increase clearance in hard to reach places to be fastened.

Another general object of the invention is to improve upon compressed air supply management during operation of the tool.

SUMMARY OF THE INVENTION

The present invention relates to a compressed fluid operated fastener driving tool, which can be selectively triggered for driving fasteners into an underlying workpiece, said tool comprising a frame, a fastener feeder for feeding fasteners to a fastener discharge mechanism of said driving tool, said fastener driving mechanism capable of shifting between a rest and an operative condition, said fastener discharge mechanism comprising:

- a housing, comprising:
  - a first chamber having a fluid inlet destined to be connected to a source of compressed fluid for keeping said first chamber pressurized,
  - a second chamber, comprising first and second fluid inlet ports for admitting compressed fluid from said first chamber into said second chamber, said second fluid inlet port capable of being selectively opened and closed, said second chamber being selectively depressurizable, said second chamber being pressurized when said fastener discharge mechanism is in said rest condition;
  - a third chamber, comprising a piston slidably mounted therein, said piston comprising a piston head and a plunger downwardly depending from said piston head, wherein said piston is biased from a first limit position towards a second limit position when said third chamber is in fluid communication with said first chamber, said piston being in said first limit position when said fastener discharge mechanism is in said rest condition;
- a valve controlling fluid communication between said first chamber and said third chamber, said valve being biased towards an open limit position when said second chamber is depressurized where fluid communication is established between said first and said third chamber, and said valve being biased towards a closed limit position when said second chamber is pressurized where fluid communication is interrupted between said first and said third chamber;

wherein after said tool is triggered, said fastener discharge mechanism passes from said rest condition to said operative condition, and said second chamber is depressurized to induce movement in said valve towards said open position, wherein when said valve is moved towards said open limit position, said second chamber second fluid inlet port is closed, and fluid communication is established between said first chamber and said third chamber, thus urging said piston towards said second limit position for allowing a fastener to be struck by said plunger and thus discharged from said tool; and wherein after said piston is moved towards said second limit position, fluid flowing into said second chamber through said first fluid inlet port pressurizes same and initiates movement of said valve towards said closed limit position, and wherein after initiation of movement of said valve towards said closed limit position, said second fluid inlet port is opened to accelerate pressurizing of said second chamber and thus accelerate movement of said valve towards said closed limit position.

In one embodiment, said second fluid inlet port is closed by being obstructed by said valve when latter is in said open limit position, and said second fluid inlet port is opened when it is cleared by said valve after initiation of the movement of said valve from said opened limit position towards said closed limit position.

In another embodiment, said fastener discharge mechanism comprises an impact receiving member, and said impact receiving member has to be struck to pass said fastener discharge mechanism from said rest condition to said operative condition.

In another embodiment, said impact receiving member comprises a hollow head member, comprising said second chamber therein.

In another embodiment, said head member comprises at least one air outlet channel made therein, opening into said second chamber at a first end, and into an atmospheric pressure fluid volume at a second end, and said second chamber can be selectively depressurized upon selective establishment of fluid communication between said second chamber and said air outlet channel second end.

In another embodiment, a peripheral wall of said valve snugly and slidably engages a peripheral wall of said second chamber, said valve being slidable about said second chamber, said valve being slid away from said second chamber when said valve is in said closed limit position, and said valve being slid towards said second chamber when said valve is in said open limit position.

In yet another embodiment of the invention, said second chamber first fluid inlet port is formed by at least one first inlet channel made in said valve, opening at a first end into said main chamber, and opening at another end into said second chamber, and said second chamber second fluid inlet port is formed by at least one second inlet channel made in said head member, opening at a first end into said main chamber, and opening at a second end into said second chamber, and said valve peripheral wall obstructs said second inlet channel second end when said valve is in said open limit position, and said second fluid inlet port is opened when said valve is not in said closed limit position.

In another embodiment, the fastener driving tool further comprises means for biasing said piston towards said first limit position when said valve is in said closed position.

In one embodiment, said third chamber is a cylinder.

In one embodiment, a shock absorbing cap is fitted on said head member.

The present invention also relates to a method for discharging a fastener out of a pneumatic fastener driving tool comprising a fastener feeder for feeding fasteners to a fastener discharge mechanism, which can be triggered to pass from a rest condition to an operative condition, and which comprises a housing having a pressurized first chamber, a selectively depressurizable second chamber comprising a first fluid inlet port and a selectively closable second fluid inlet port, said second fluid inlet port being open and said second chamber being pressurized when said tool is in said rest condition, and a third chamber in which a piston having a plunger is slidably mounted, said piston being movable between retracted and deployed limit positions and being biased towards said deployed limit position when fluid communication between said first and said third chambers is established, a valve being further nested within said housing and permitting selective establishment of fluid communication between said first and said third chamber, said method comprising the steps of:

(a) triggering said fastener discharge mechanism to pass it in said operative condition;
(b) depressurizing said second chamber and closing said second fluid inlet port thereof;
(c) since said second chamber is depressurized, displacing said valve towards said open position to establish fluid communication between said first and said third chambers;
(d) displacing said piston towards said deployed limit position;
(e) striking a fastener with said plunger to discharge a fastener from said tool;
(f) admitting compressed fluid into said second chamber from said first chamber through said first fluid inlet port to pressurize said second chamber and thus initiate movement of said valve towards said closed position; and
(g) once movement of said valve is initiated, opening said second fluid inlet port to further admit compressed fluid into said second chamber, to further pressurize the latter and accelerate displacement of said valve towards said closed position.

In one embodiment, said method further comprises the step, after step (g), of biasing said piston towards said retracted limit position.

The present invention also relates to a pneumatic nailer for use with floor securing cleats in working in hard to reach floor areas, said nailer comprising a main frame, a first air chamber, a second air chamber, a piston member reciprocatingly movable through said second air chamber, said piston member defining a plunger having at a bottom end a striker head for striking and ejecting selected floor securing cleats in successive reciprocating cycles with the cleats located outwardly of said second air chamber, and at a top end a piston head, wherein said second air chamber forms an upper subchamber and a lower subchamber on opposite sides of said piston head in substantially airtight fashion relative to one another wherein said upper subchamber and said lower subchamber are of complementarily inversely variable volume, said upper subchamber in fluid communication with said first air chamber, a third air chamber in fluid communication with said lower subchamber, first valve means controlling air flow from said first air chamber to said upper subchamber, said first air chamber adapted to contain continuous over atmospheric air pressure level thereinto, unidirectional second valve means controlling air flow from said lower subchamber to said third air chamber, first channel means for through air flow between said lower subchamber and said third air chamber responsively to an air pressure differential therebetween, and trigger means for releasably moving said first valve means from a closed condition to an opened condition enabling air flow from said first air chamber to said upper subchamber; wherein said first valve means includes means to adjust the duration of each of said reciprocating cycles of said piston member.

In one embodiment, said pneumatic nailer further includes a guide member, mounted to said main frame and opening into said lower subchamber of said second air chamber, said guide member including a central slit slidably engaged by said plunger for guiding motion of said plunger during said reciprocating cycles thereof.

In one embodiment, said second air chamber defines a peripheral wall section having an inner wall, slidably engaged by said piston head, and an outer wall, a first series of registering access bores made into said wall section and opening into said third air chamber, and said second valve means consists of an elastic band applied against said second air chamber outer wall in releasable sealing register with said access bores of said wall section of said second air chamber.

In one embodiment, the material nature of said guide ring member and the size of said guide ring member central slit relative to the section of said plunger slidably engaging through said slit, are such that any overpressure inside said lower subchamber will be allowed to outwardly leak at a controlled rate through said slit toward ambient air.

In another embodiment, said trigger means includes an anvil member having an outer exposed section and an inner section, said anvil member movably mounted to said main frame between an extended position and a retracted position, a fourth air chamber in fluid communication with said first air chamber through a fluid passageway, and third valve means opening said fluid passageway at said extended position of said anvil member and closing said fluid passageway at said retracted position of said anvil member, and air outlet means providing air outflow from said fourth air chamber after said anvil member leaves said extended position thereof;

wherein said air outflow from said air outlet means provides the biasing means that biases said first valve means to move from its said closed condition to its said opened condition.

In another embodiment, said trigger means and said first valve means are mounted in a screwtube releasably screwable into a threaded access bore in said main frame.

In another embodiment, said pneumatic nailer further includes a combined screw mount assembly for releasably screwing said trigger means and said first valve means to said main frame, for facilitating manual access to said second air chamber and to said piston head for maintenance purposes.

In another embodiment, said pneumatic nailer further includes a damper cover, mounted to said exposed section of said anvil member, said damper cover made from a shock absorbing material.

DETAILED DESCRIPTION OF THE EMBODIMENTS

Figure 1:
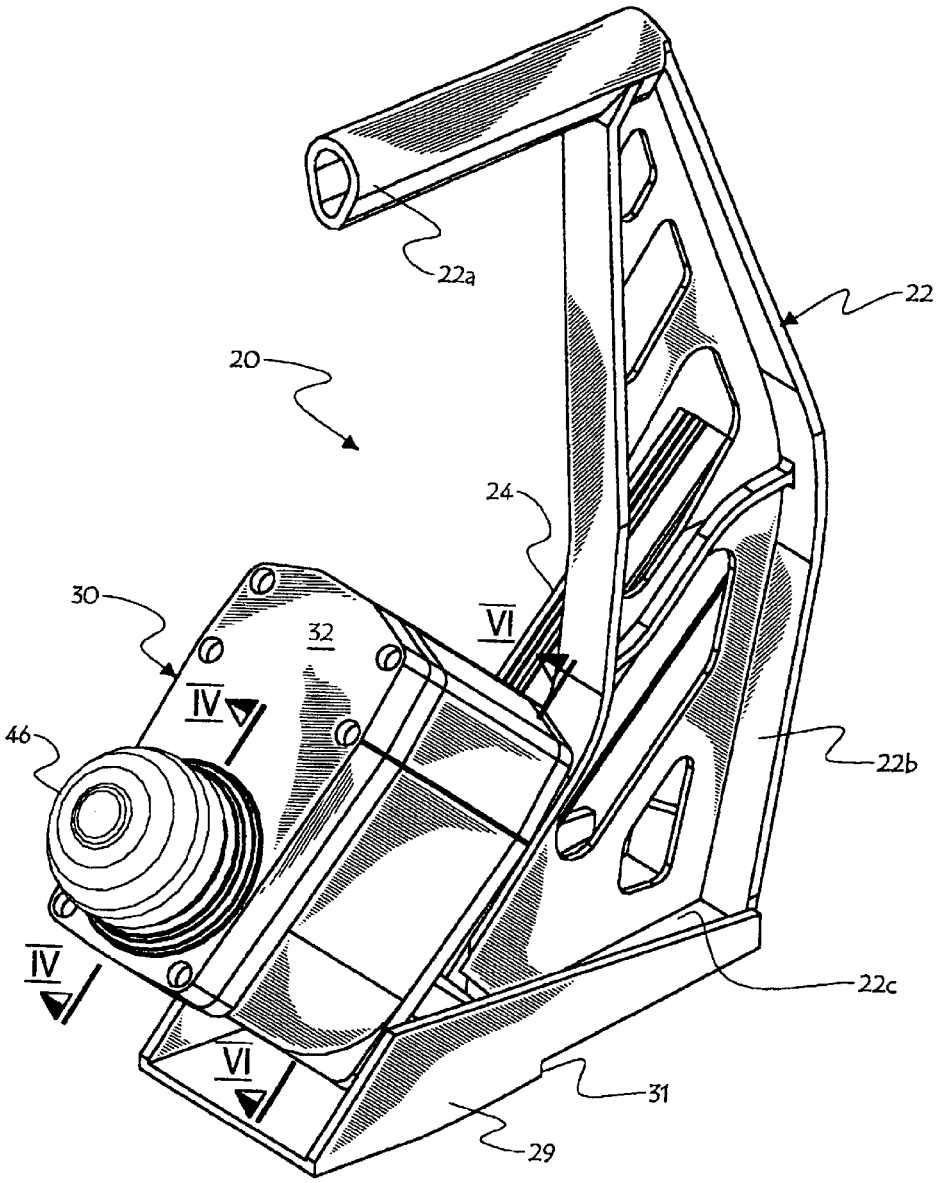
FIG. 1 is a front perspective view of a pneumatic tool according to the present invention.
Figure 2:
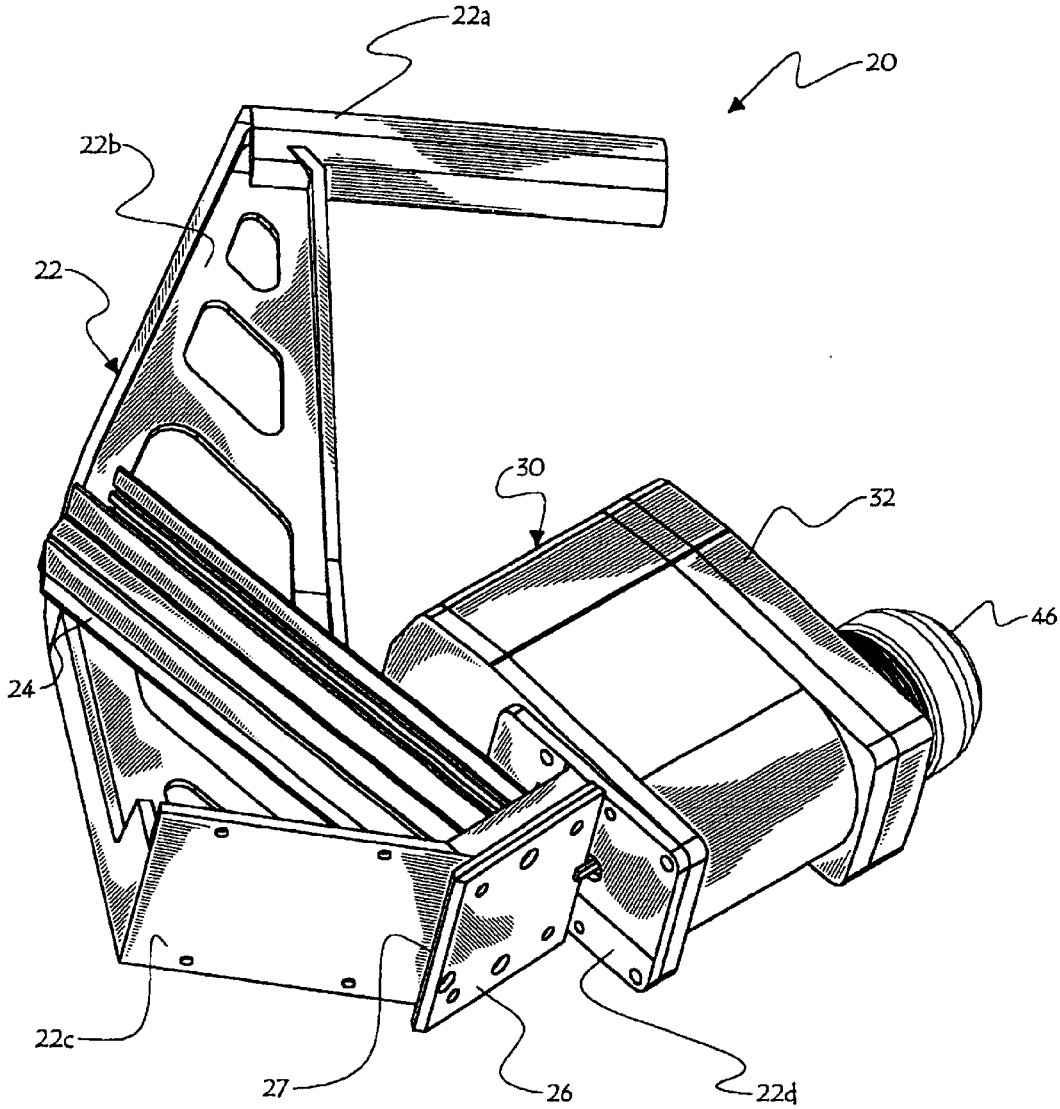
FIG. 2 is a bottom perspective view at a smaller scale of the tool of FIG. 1, with the bottom slider shoe thereof being removed for clarity of the view.

FIGS. 1–2 generally show a pneumatic mallet-operated fastener driving tool 20 according to the present invention, used for securing hardwood planks to a subfloor.

Tool 20 comprise a G-shaped frame 22, made of a one-piece moulded metal for example, defining a handle portion 22*a* integrally attached to one end of an arm portion 22*b*, which integrally carries an elbowed baseplate 22*c* at its other end. Elbowed baseplate 22*c* integrally carries an attachment plate 22*d*. A fastener feeder in the form of an elongated magazine 24 is affixed to one side of frame arm 22*b* in a rearwardly upwardly sloped fashion, and is for holding a supply of fasteners, e.g. a strip of metallic L- or T-shaped barb-provided cleats commonly used in floor assembling duties. A launch plate 26 (concealed in FIG. 1, but shown in FIG. 2), made from an assembly of two plates for ease of manufacture purposes, is affixed to the bottom surface of elbowed baseplate 22*c* perpendicularly to elongated magazine 24. Magazine 24 comprises biasing means (not shown) for biasing a strip of cleats loaded therein towards launch plate 26, so that the first cleat of the strip engages an elongated ejection-guiding groove 27 made in launch plate 26, from where this cleat will be struck by a pneumatically driven plunger 28 (shown for example in FIG. 3), to be ejected from the tool and driven into a subjacent workpiece, as described hereinafter.

As only shown in FIG. 1, an elongated shoe 29, made of plastic for example, preferably engages the bottom surface of baseplate 22*c*, and forms the member of tool 20 which will rest on the subjacent workpiece prior to triggering a fastener discharge cycle of the tool. Shoe 29 has a step-shaped indentation 31 used for suitably positioning tool 20 relative the workpiece it will be used on, as described hereinafter.

Figure 3:
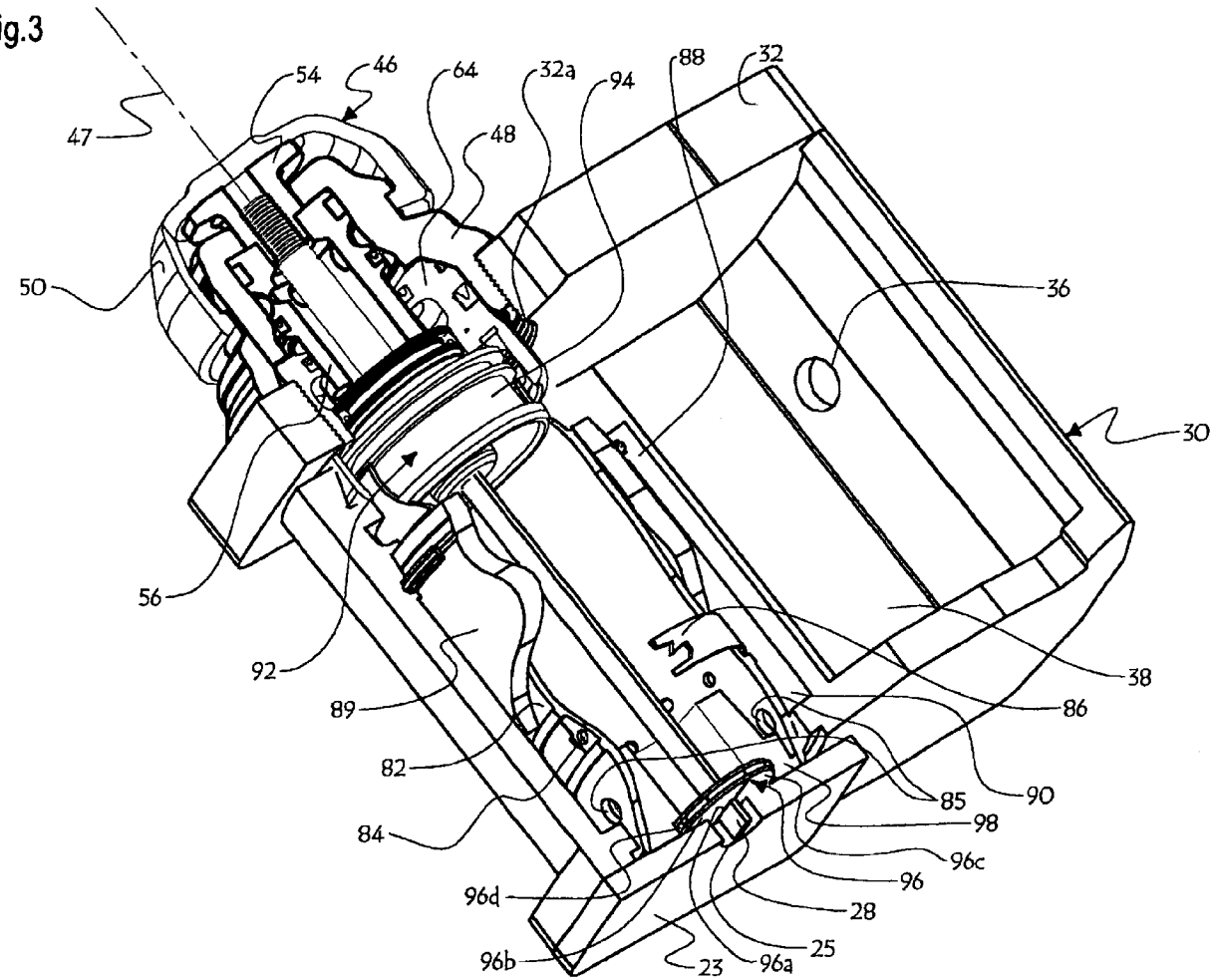
FIG. 3 shows an enlarged perspective partly broken view of the fastener discharge mechanism of the tool of FIG. 1, to show the inside content thereof.

Moreover, tool 20 comprises a fastener discharge mechanism 30. As seen in FIGS. 2–3, fastener discharge mechanism 30 comprises a housing 32, made of two parts for ease of manufacture i.e. a hollow body and a head baseplate, the bottom surface of housing 32 being secured to a guide plate 23 comprising a circular guide hole 25 made therein, guide plate 23 being in turn secured to attachment plate 22*d* of frame 22. Guide hole 25 registers with plunger 28, and plunger 28 reciprocates within guide hole 25 during nailing cycles of the tool. A compressed air intake port 36 is made in housing 32. A flexible hose (not shown), connected at one end to a compressed air source such as an air compressor or a compressed air cylinder (not shown), can be connected at the other end to air intake port 36, for feeding compressed air to fastener discharge mechanism 30. Air intake port 36 opens into a first or main chamber 38 of fastener discharge mechanism 30.

Figure 4:
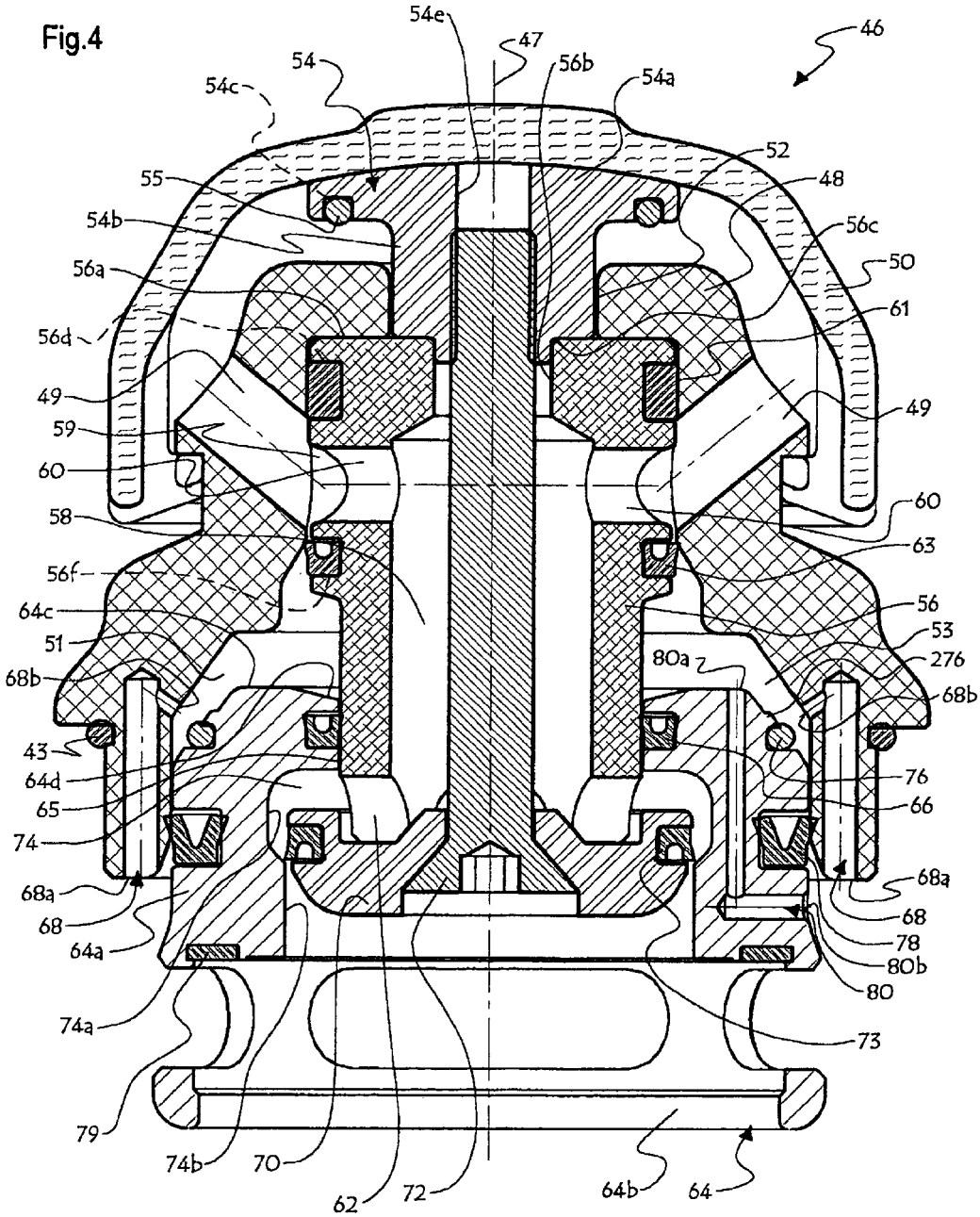
FIG. 4 shows an enlarged front cross-sectional view of the impact receiving member of the tool taken along lines IV—IV in FIG. 1.

A metallic impact receiving member or anvil 46 is threadingly fitted in a circular threaded opening made transversely across the top surface of housing 32. The engagement of impact receiving member 46 to housing 32 is kept airtight by an annular seal 43 (shown in isolation in FIG. 4 and in sealing compressed engagement therewith in FIG. 8). Impact receiving member 46 forms the anvil member that a workman will strike with a mallet for example, to set off tool 20 and drive a cleat in a subjacent workpiece, as described hereinafter. Impact receiving member 46 comprises a hollow head member 48 with external screw threads 47*a* (FIG. 5) defining a central axis 47, on top of which is releasably snap-fitted a cap 50 made for example of rubber or plastic; cap 50 comprises perforations thereon, to allow fluid circulation between both sides thereof. Cap 50 is sized to almost fully enclose the upper end portion of head member 48, thus protecting the latter against accidental impact on walls or floors. Sound dampening properties are also achieved with cap 50 during nailing stroke cycles. Cap 50 will also prevent accidental spatters of lubricant outwardly from head 48, which may happen when the tool is excessively lubricated. However, even without protective cap 50, trigger 54 is fully operational and the hammer can strike directly on impact receiving member 54. Head member 48 is made for example of a lathed metal block, and comprises a cavity therein forming a head cavity 51. The threads 47*a* of head member 48 screwingly releasably engage complementary threads 32*a* of housing 32. A number of air outlet channels 49 are radially inwardly downwardly bored in head member 48, and open to head cavity 51. In one embodiment (not shown in the figures), there are four regularly spaced-apart air outlet channels 49 made in head member 48. Additionally, head member 48 is provided with a number of air inlet channels 68; only two air inlet channels 68 are shown in FIG. 4, but more or less of such air inlet channels could be provided in alternate embodiments of the invention. Air inlet charnels 68 open transversely onto head cavity 51 at one elbowed inner end portion 68*b*, and onto main chamber 38 at the other outer end 68*a*. Preferably, end portion 68*b* make a large acute angle with the main body of elbowed channel 68.

Figure 7:
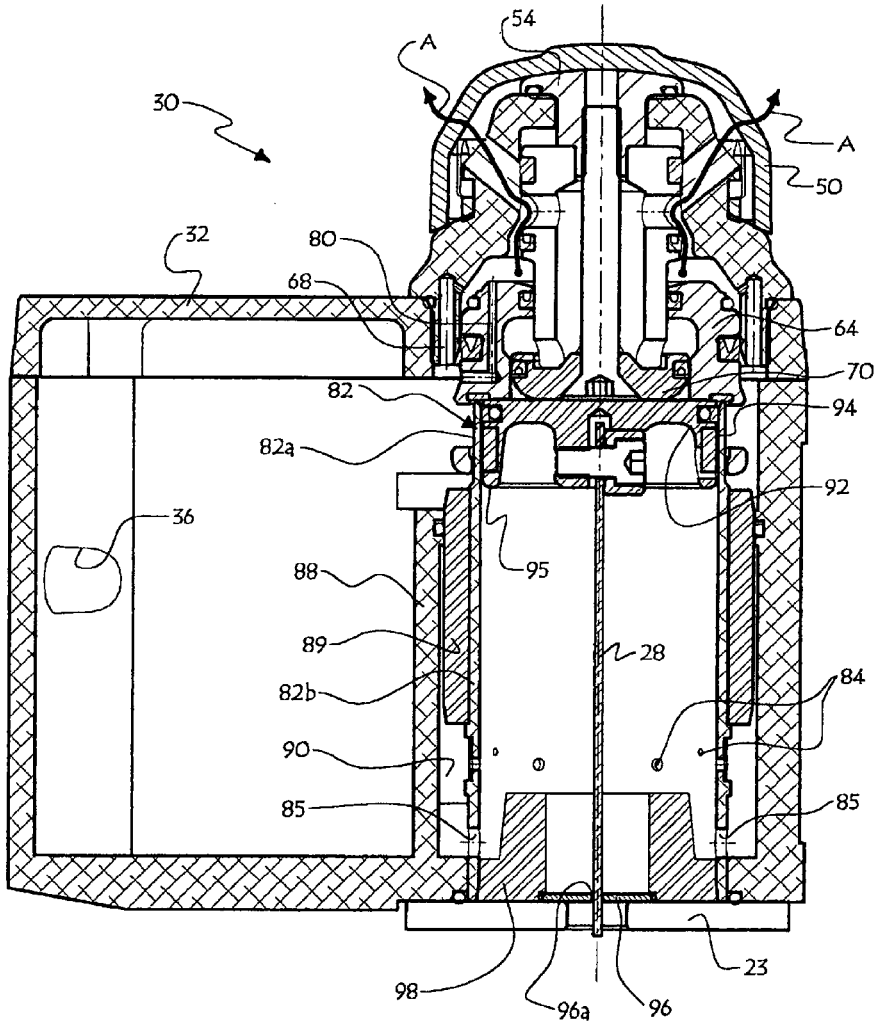

A transverse trigger-accommodating opening 52 is made through the upper end portion of head member 48, coaxially with central axis 47, and opens into head cavity 51. A trigger 54 is mounted in trigger-accommodating opening 52, and comprises a discoid upper impact-receiving portion 54*a* and a lower sliding portion 54*b*. Sliding portion 54*b* slidably engages the inner peripheral wall of opening 52, allowing trigger 54 to be slidably movable between a rest position as shown for example in FIG. 4, where impact-receiving portion 54*b* is spaced-apart from the upper surface of head member 48, and an operative position as shown in FIG. 7 for example, where the bottom surface of impact-receiving portion 54*a* comes to engage with and is pressed against the upper surface of head member 48. Impact-receiving portion 54*a* is the member towards which the mallet blow of a workman will be directed in order to move trigger 54 from its rest position towards its operative position, which will result in tool 20 discharging a cleat. Hence, to limit vibrations arising from the mallet blow, a toroidal ring 55 (called O-ring 55 hereafter), made of a resilient shock-absorbing material such as rubber, is preferably nested in a complementary toroidal channel 54*c* made on the bottom surface of impact receiving portion 54*a*, for comfort of the user.

A cylindroid elongated air evacuation member 56 is nested within head cavity 51, coaxially with central axis 47. The top surface 56*a* of air evacuation member 56 is centrally bored at 56*b*, and the corner rim portion 56*c* of member 56 engages a peripheral indentation made in the lower free end portion of trigger sliding portion 54*b*. A toroidal wear ring 61 nested in a complementary annular channel 56*d* made radially in the outer surface of air evacuation member 56. Air evacuation member 56 is hollow and defines an evacuation airway 58 therein. Moreover, an annular cross-sectionally semi-circular recess 59 is made peripherally in the outer wall of air evacuation member 56, beneath wear ring 61. A number of through-holes 60 are made radially in air evacuation member 56, in register with this recess 59; in one embodiment, air evacuation member 56 is provided with four peripherally spaced through-holes 60. Through-holes 60 are meant to keep evacuation airway 58 in fluid communication with air outlet channels 49 and thus with the atmosphere. Moreover, a toroidal, cross-sectionally U-shaped seal 63 (called U-cup 63 hereinafter), is nested in a complementary annular channel 56*f* made in the outer wall of air evacuation member 56, beneath recess 59.

Figure 5:
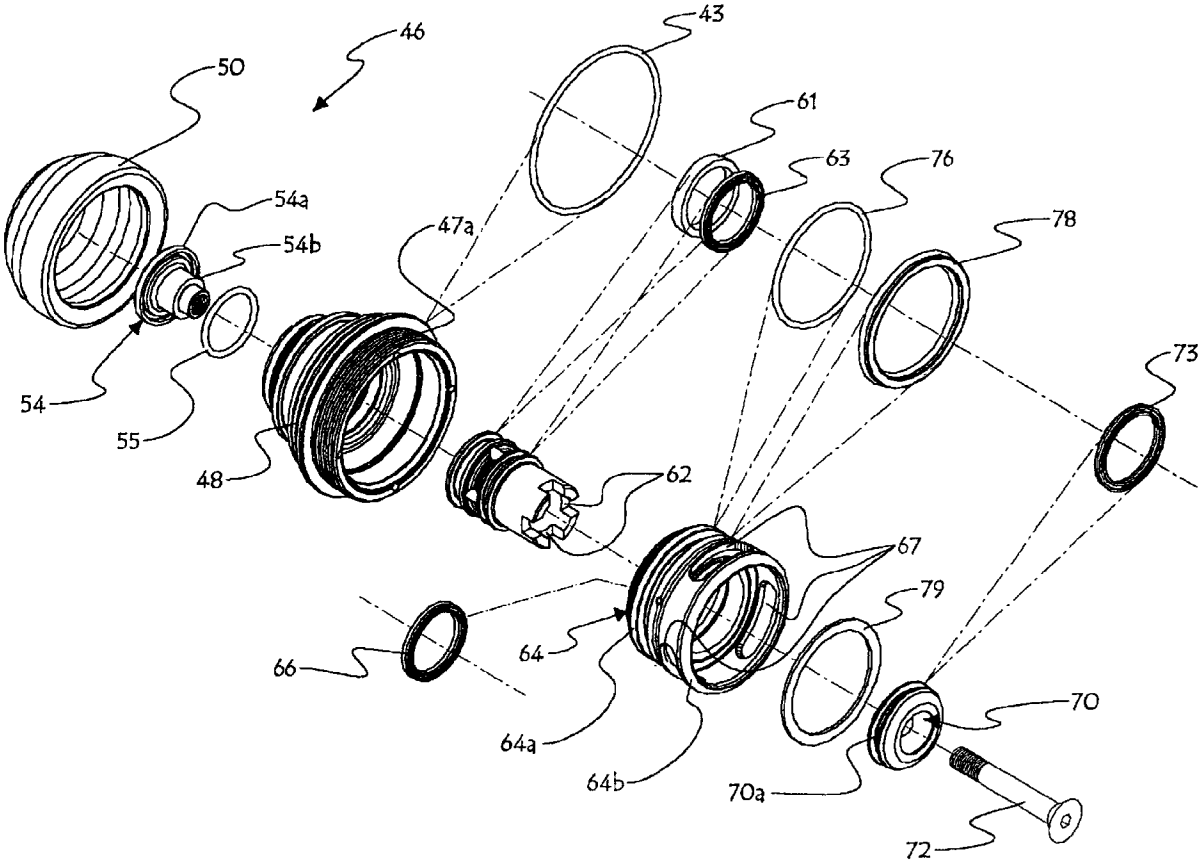
FIG. 5 shows an enlarged perspective exploded view of the impact receiving member of the tool of FIG. 1.

Notches 62 are made in air evacuation member 56, at the bottom free end portion thereof (as best shown in FIG. 5). An annular discoid closure plate 70, comprising an annular seal in the form of a U-cup 73 nested in a dedicated annular recess 70*a* made in its peripheral wall, is pressed against the bottom extremity of air evacuation member 56. An elongated bolt 72 coaxial with central axis 47 extends through the hollow of annular closure plate 70, through airway 58, and into a threaded bore 54*e* made centrically in trigger 54, to which it is screwed; closure plate 70, air evacuation member 56 and trigger 54 are thereby fastened together, and will move as one during operation of the tool.

Accordingly, as sequentially shown by FIGS. 4 and 7, downward movement of trigger member 54 from its rest position towards its operative position results in similar downward movement of air evacuation member 56 and closure plate 70 from a rest position (as shown in FIG. 4) towards an operative position (as shown in FIG. 7). In the rest position, U-cup 63 of air evacuation member 56 peripherally and snugly engages the peripheral wall of head cavity 51; when the latter is in its operative position, U-cup 63 clears the wall of head cavity 51.

Figure 6:
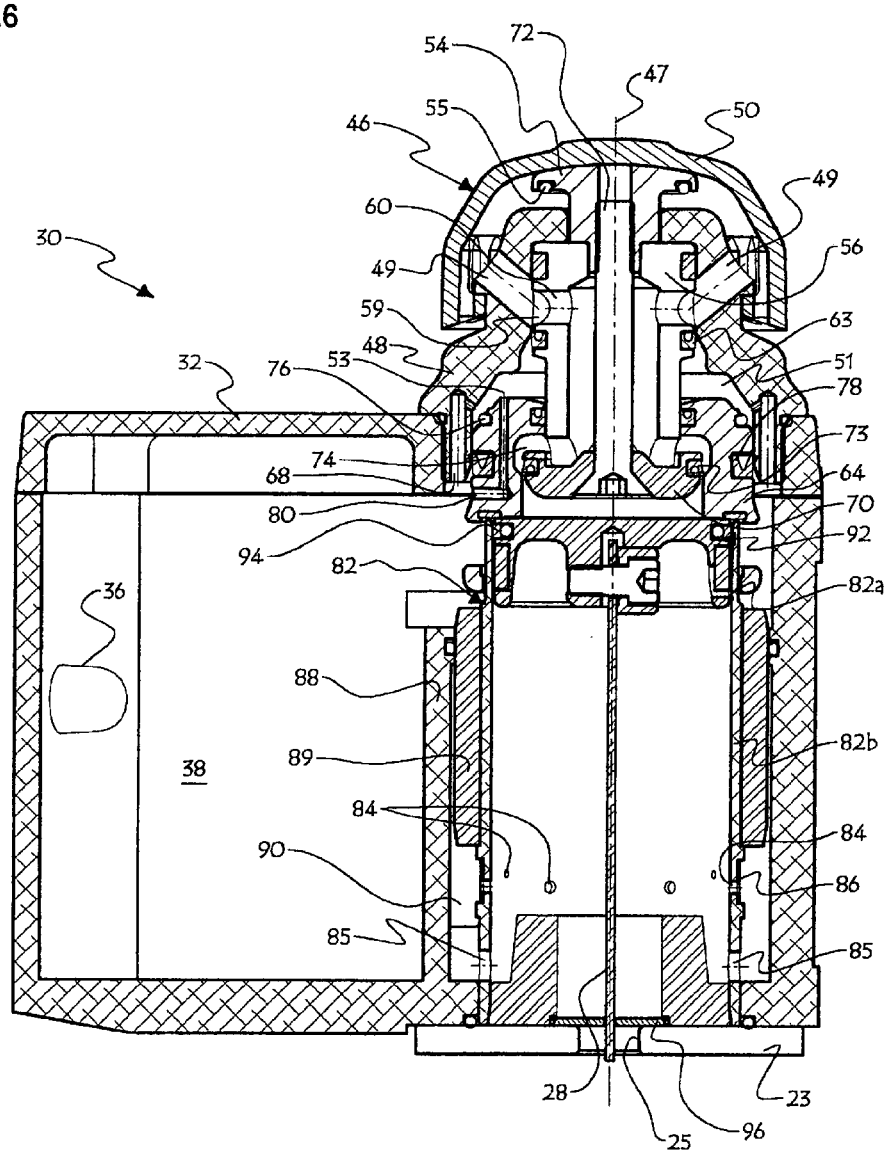
FIGS. 6 to 12 all show an enlarged front cross-sectional view of the fastener discharge mechanism taken along lines VI—VI in FIG. 1, and sequentially show the relative displacement of internal parts of the fastener discharge mechanism during a fastener discharge cycle of the tool.

A two-tiered valve 64 is coupled to the assembly of closure plate 70 and air evacuation member 56, and can slide inwardly or outwardly of head cavity 51, coaxially with axis 47, between a closed and an open position. Preferably, the shape of valve 64 relative to that of the peripheral wall of head cavity 51 is such that self-guiding properties are imparted to valve 64 when moving between its open and closed positions. The portion of head cavity 51 delimited by the upper surface of a valve upper portion 64*a* and U-cup 63 installed peripherally on air evacuation chamber 56 will be further referred to as closure chamber 53; of course, since valve 64 is slidable within head cavity 51, closure chamber 53 is of variable inner volume. Air pressure acting within closure chamber 53 will control opening and closure of valve 64, as described hereinafter. Upper portion 64*a* has a central hole 65 on its top surface 64*c* chamfered at 64*d* and opening downwardly into a valve inner cavity 74, and a lower portion 64*b*. Air evacuation member 56 extends through valve access hole 65, with closure plate 70 being nested in valve inner cavity 74, and the outer wall of evacuation member 56 snugly yet slidably engages valve 64 at valve hole 65, in an airtight fashion due to the presence of a U-cup 66 attached to valve upper portion 64*a*. Valve inner cavity 74 comprises a broad upper portion 74*a*, and a narrowed lower portion 74*b*, the latter having a diameter substantially equal to the external diameter of closure plate 70. When air evacuation member 56 is in its rest position and valve 64 is in its closed position (as shown in FIG. 6 for example), closure plate 70 is located above and does not engage the narrowed portion of valve inner cavity 70 thus allowing fluid communication between valve inner cavity 74 and the air volume located beneath closure plate 70, but otherwise closure plate 70 engages the narrowed portion 74*b* of valve inner cavity 74 in an airtight fashion, thus cutting off fluid communication between valve inner cavity 74 and the air volume located beneath closure plate 70. It is to be noted that valve inner cavity 74 is in fluid communication with airway 58 through notches 62 regardless of the relative position of valve 64 and air evacuation member 56 during nailing cycles.

Still in FIG. 4, a number of elbowed air feed closure channels 80 are drilled in valve upper portion 64*a* (with only one closure channel 80 being shown in the figures); an inner end 80*a* of closure channel 80 opens into closure chamber 53 of head cavity 51, and its outer radial end 80*b* opens into main chamber 38.

The outer peripheral wall of valve upper portion 64*a* is fitted, in annular recesses made expressly therefor, with two complementary annular seals, an O-ring 76 and a U-cup 78 positioned below O-ring 76. Regardless of the position of valve 64 within head cavity 51:

- U-cup 78 engages the peripheral wall of head cavity 51, preventing fluid leaks through the engagement of valve 64 with the wall of head cavity 51; and
- fluid communication between the main chamber 38 and closure chamber 53 is established through elbowed closure channels 80.

Figure 8:
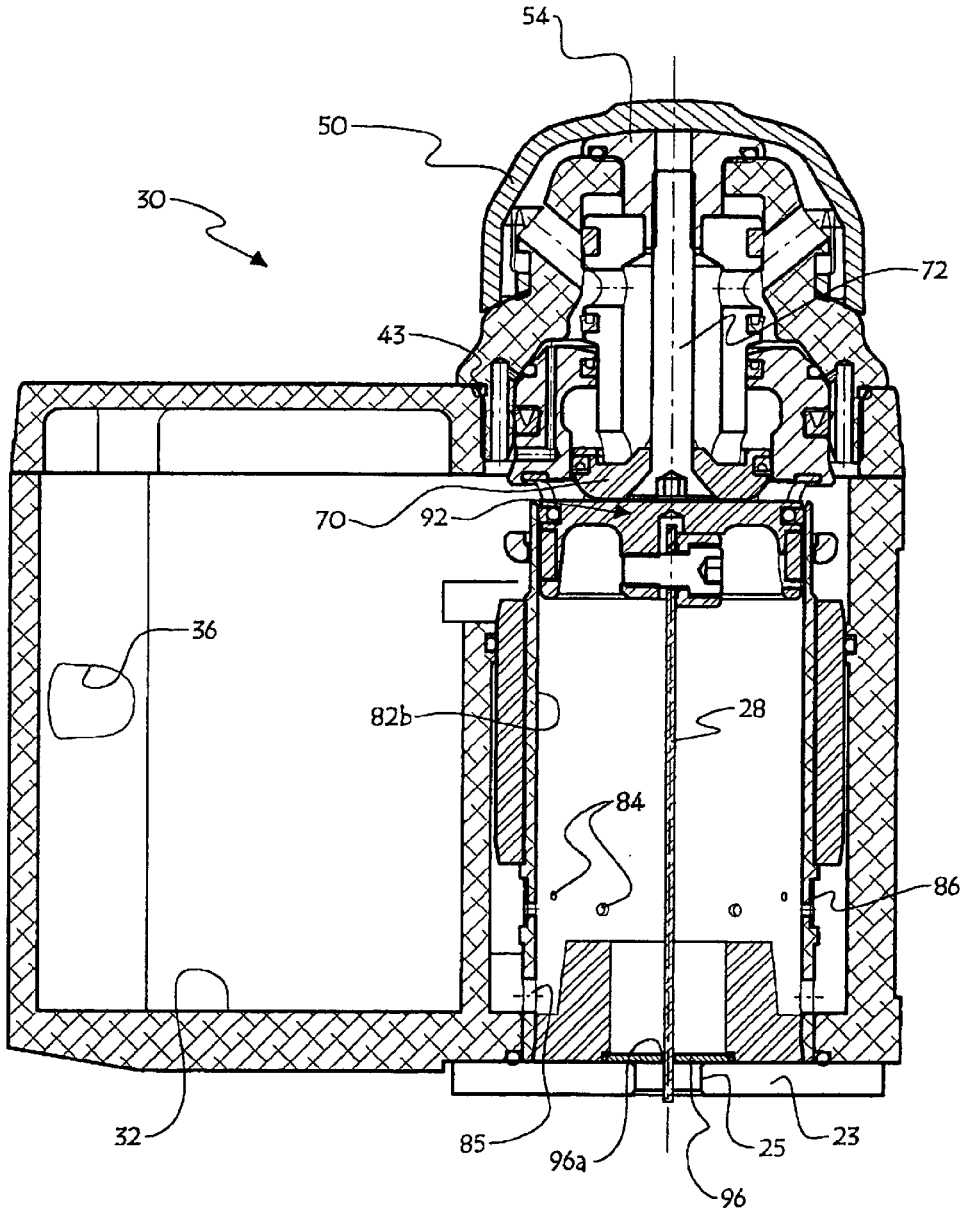
Figure 9:
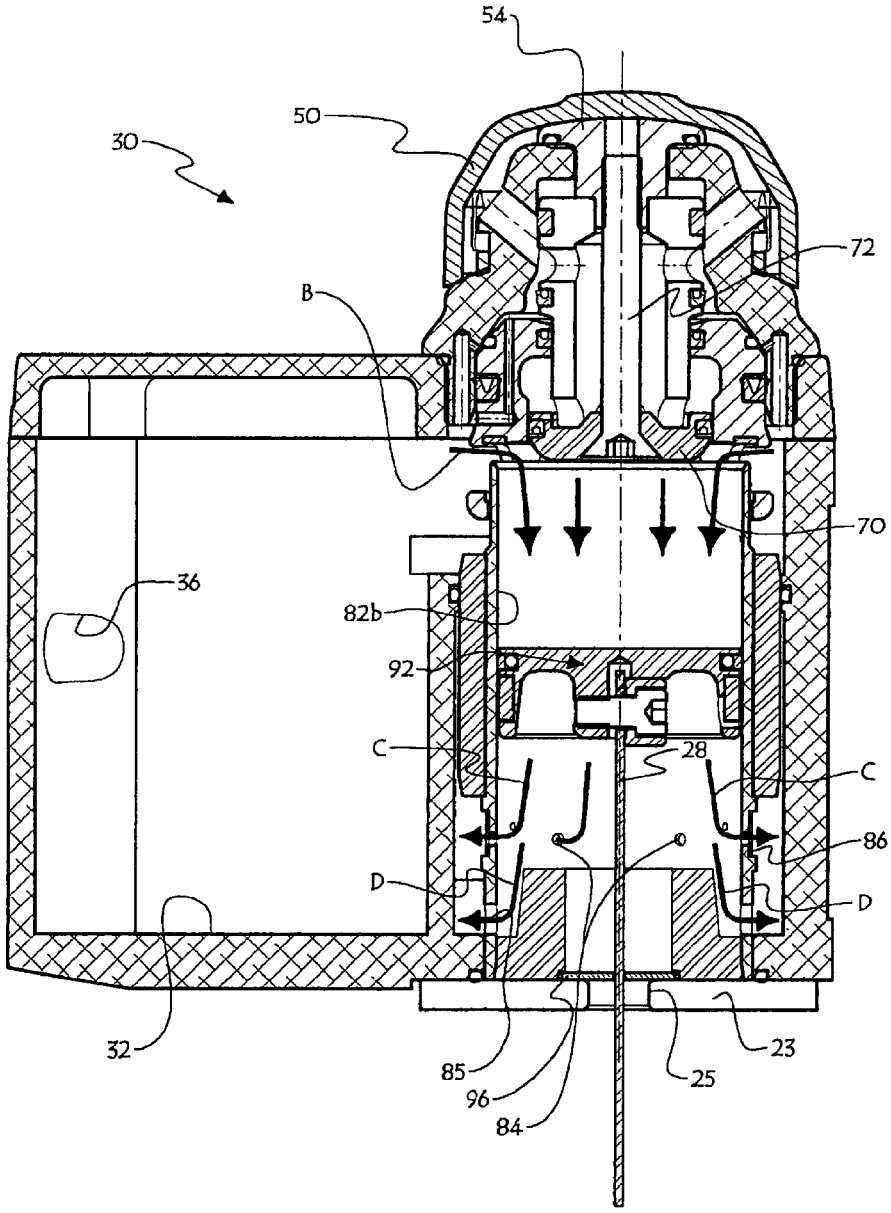

In addition, when valve 64 is in its open position, the peripheral wall of valve upper portion 64*b* is pressed against and obstructs end 68*a* of air inlet channel 68, and residual fluid flow, which may leak out of air inlet channel end 68*a* even though it is obstructed, is prevented from infiltrating closure chamber 53 by O-ring 76, as shown in FIG. 8 for example.

Valve lower portion 64*b*, on the other hand, generally comprises a cylindroid wall in which a series of horizontal elongated apertures 67 are made (as best shown in FIG. 5). Valve lower portion 64*b* depends into main chamber 38, and is snugly slidably fitted around an upper rim portion 82*a* of a cylinder 82, as shown in FIGS. 3 and 6–12. Such snug and slidable engagement of valve lower end portion 64*b* and cylinder upper rim portion 82 also impart a self-guiding capability to valve 64 when the latter moves axially along axis 47 between its closed and open positions. Cylinder 82 defines an enclosure that is usually at atmospheric pressure except during nailing stroke cycles. It is to be noted that when valve 64 is pushed downwardly in its closed position, apertures 67 are covered by the outer wall of cylinder upper rim portion 82*a*, valve 64 airtightly engages upper rim portion 82*a* owing to the presence of an annular seal 79, and fluid communication between the inside of cylinder 82 and main chamber 38 is blocked. However, when valve 64 is pushed up in its open position, apertures 67 are partly uncovered by the outer wall of upper rim portion 82*a*, and fluid communication is established between main chamber 38 and the inner chamber of cylinder 82.

Cylinder 82 is coaxially aligned with central axis 47, and comprises a cylinder body 82*b* below upper rim portion 82*a*. The lower end of cylinder body 82*b* is fitted in a registering hole made in the bottom surface of housing 32, and its lower rim abuts against guide plate 23. A partition 88, integral to housing 32, surrounds the entire length of cylinder body 82*b* spacedly therefrom, and a collar 89 snugly surrounds the upper portion of cylinder body 82*b*. An enclosure in the form of auxiliary chamber 90 is formed between the outer wall of either cylinder body 82*b* or collar 89 and partition 88.

Furthermore, a number of peripherally spaced small escape holes 84 are made in cylinder body 82*b*, in the lower portion thereof. A narrow elastic band 86 is stretched radially around the outer face of cylinder 82, and covers holes 84, so as to only permit unidirectional radially outward fluid flow from the inside of cylinder 82 to auxiliary chamber 90 through escape holes 84, but not radially inwardly from auxiliary chamber 90 to the inside of cylinder 82. Another set of larger holes 85 are made in cylinder main body 82*b*, adjacent the lowermost extremity of cylinder 82.

A piston 92, comprising a piston head 94 and a cross-sectionally rectangular plunger 28 (introduced above) is slidably installed within cylinder 82 coaxially therewith. Plunger 28 registers with notch 27 made in launch plate 26. A peripheral flange (FIG. 6) depends downwardly from the upper surface of piston head 94, and the outer surface of flange 95 slidably yet snugly engages the inner wall of cylinder 82 and in an airtight fashion.

Figure 12:
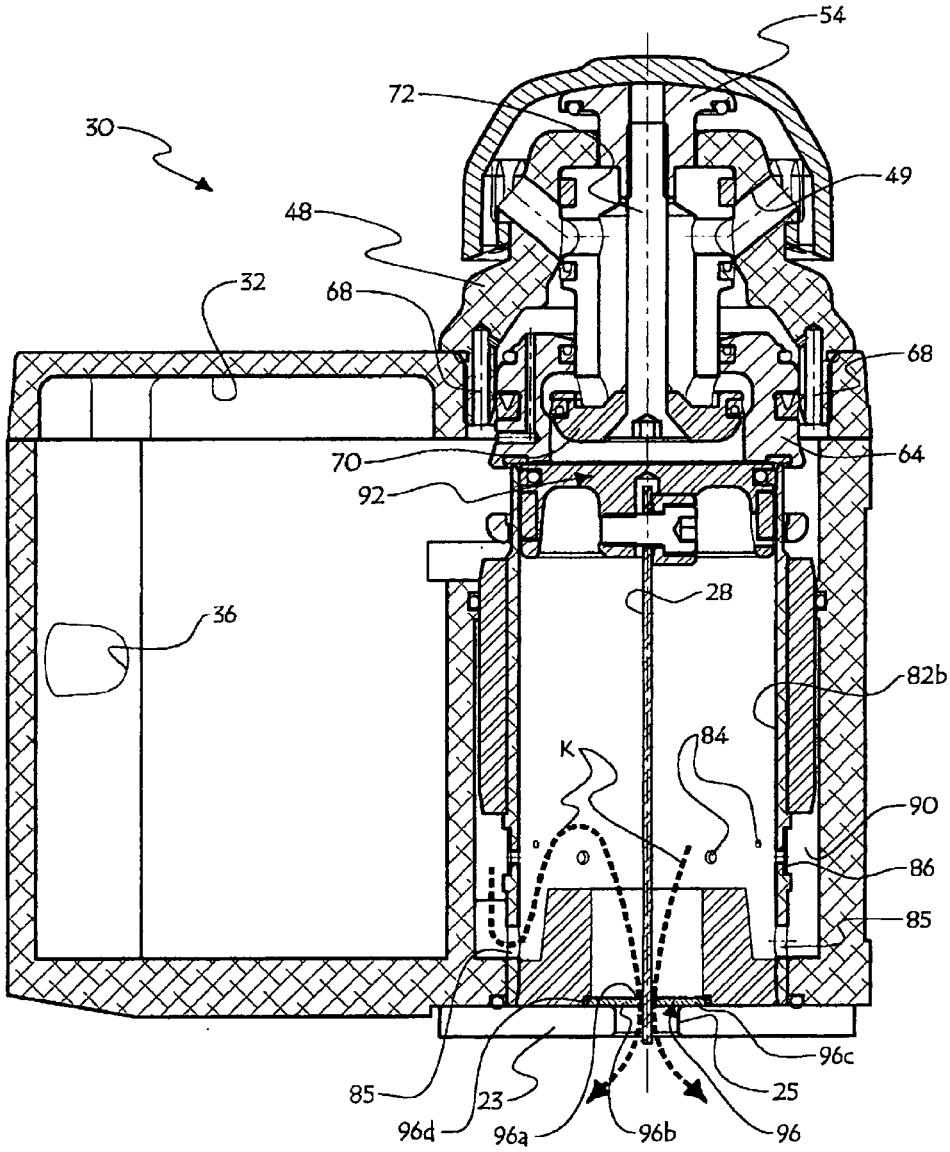

Plunger 28 extends through a guiding ring 96 bearing against guide plate 23 and centered relative to guide hole 25. Guide ring 96 is composed of two ring halves 96*b* and 96*c*, as illustrated in FIGS. 3 and 12, fitted together and biased towards one another and towards plunger 28 by a resilient toroidal O-ring 96*d*. The axial slit through which plunger 28 extends in guide ring 96, defined centrically thereon at the interconnection between halves 96*b* and 96*c*, is labelled 96*a* in the figures, and is wider than plunger 28. O-ring 96*d* maintains the two rings halves 96*b*, 96*c* biased against the main wider faces of plunger 28. A differential air pressure between upstream and downstream ends of ring 96 is insufficient to bias halves 96*b*, 96*c* away from plunger 28, and therefore, no air leakage is ever produced along the face of plunger 28. However, since slit 96*a* is wider than plunger 28, the two gaps formed between the opposite two narrower side edges of plunger 28 and corresponding registering sections of ring halves 96*b*, 96*c* respectively, form air passageways constituting an air leakage zone to compensate for any differential air pressure between upstream and downstream ends of ring 96, such leakage being shown by arrows K in FIG. 12. It is to be noted that such controlled leakage is properly achieved during the entire life cycle of tool 20. Indeed, O-ring 96*d* will continuously bias ring halves 96*b* and 96*c* towards the wider face of plunger 28, with very little effect from wear occurring upon repetitive sliding motion of plunger 28 against ring halves 96*b* and 96*c* during repeated nailing cycles of tool 20. Therefore, guiding ring 96 provides a continuous yet controlled air leakage outflow which will vary very little even considering frictional wear of its components.

A discharge damper 98 diametrically larger than ring 96, made of a shock-absorbing material such as rubber is installed within and at the bottom end of cylinder 82, and bears against guide plate 23, in order for guide ring 96 to be interposed between damper 98 and guide plate 23. Discharge damper 98 is shaped such that its top surface matches the shape of the undersurface of piston head 94.

Figure 10:
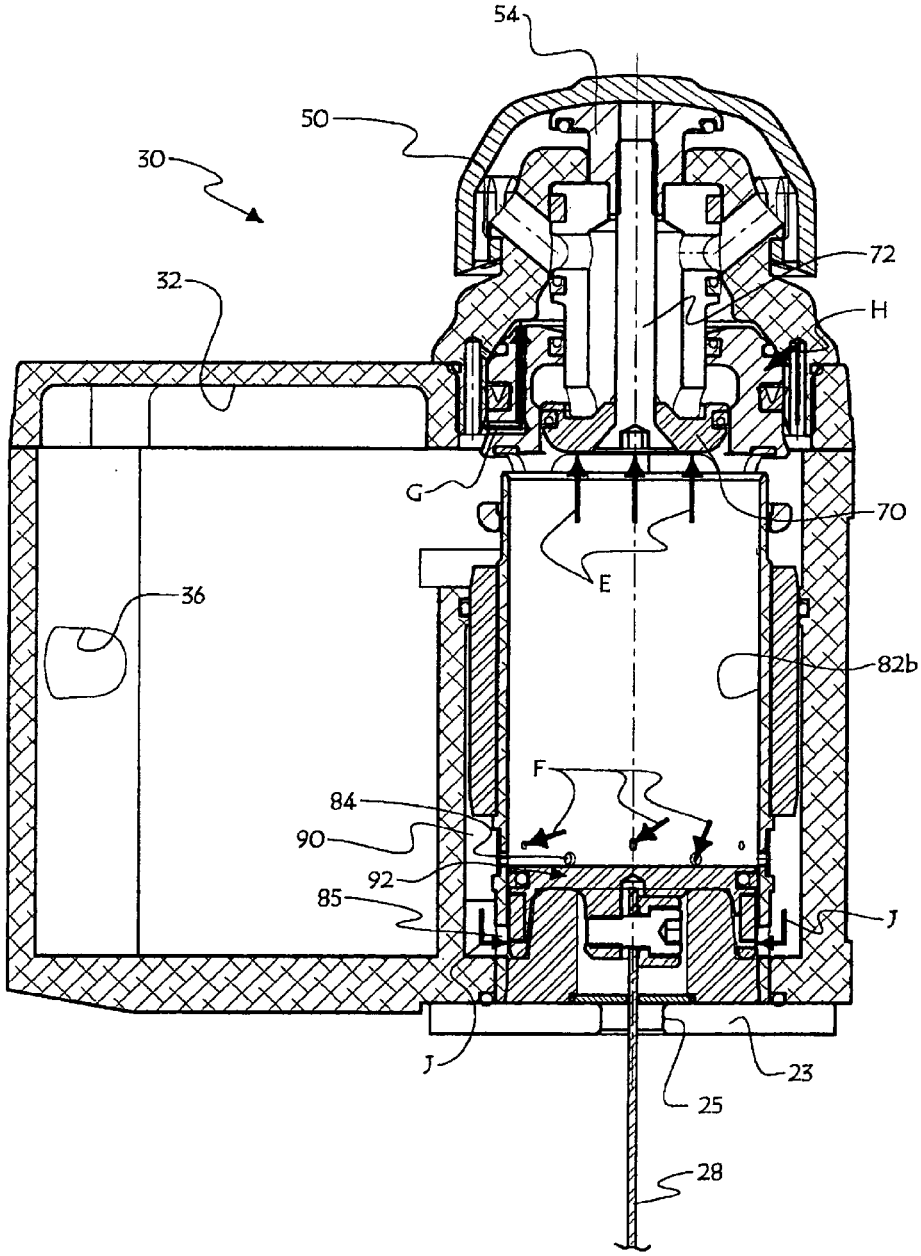

Piston 92 can slide within cylinder 82 between a retracted limit position, as shown in FIG. 6 for example, where the top surface of piston head 94 comes in register with the upper rim of cylinder 82, and a deployed limit position as shown in FIG. 10 for example, where the undersurface of piston head 94 snugly engages discharge damper 98 and plunger 28 is extracted out of cylinder 92 through the aperture made in guide ring 96 and guide hole 25.

In preparation for operation of tool 20, a hose, connected at one end to a compressed air source, is connected at the other end to compressed air intake port 36, and magazine 24 is loaded with a strip of cleats. When the tool is at rest, as shown in FIG. 6, piston 92 is in its upper limit position, and closure chamber 53 is pressurized. Air pressure within closure chamber 53 is substantially equal to that of main chamber 38, but since the surface area of valve 64 exposed to closure chamber 53 is greater than that exposed to main chamber 38, the pressure-borne force acting on valve 64 from within said closure chamber 53 is greater than that acting thereon from within main chamber 38, and hence a net downward force is applied on valve 64, thus urging it downwardly towards its closed position and thus towards the upper rim of cylinder 82.

To use the tool, and trigger a fastener discharge cycle thereof, a workman grabs it by handle 22*a*, and places it on top of a workpiece such as a hardwood plank which has been previously been placed at a desired anchoring location on the subfloor. Tool 20 has to be positioned relative to the plank such that indentation 31 made in shoe 29 bears against an upper edge of the plank. A substantial force is required to push trigger 54 down, e.g. a 35 pound force, a safety feature preventing accidental release of the trigger by simple manual push. Therefore, once the tool is properly positioned, the workman strikes the obliquely oriented impact receiving member 46 with a mallet or a hammer, and directs his blow coaxially with axis 47 and towards trigger member 54. When trigger 54 is struck, it is pushed against the bias of compressed air pressurizing closure chamber 53, from its rest position (FIG. 6) to its operative position (FIG. 7). Concomitantly, air evacuation member 56, which moves as one with trigger 54, will be moved from its rest position towards its operative position, and closure plate 70 is pushed down to become airtightly engaged on the wall of the narrowed portion 74*b* of valve inner cavity 74. In this operative position, U-cup 63 does not engage the wall of head cavity 51, and closure chamber 53 is in fluid communication with the atmosphere through air outlet channels 49. Consequently, closure chamber 53 is depressurized through the depressurizing port formed by air outlet channels 49, as suggested by arrow A in FIG. 7, and the air pressure within closure chamber 53 instantly drops. As a consequence, since closure chamber 53 is depressurized while main chamber 38 is pressurized, a differential air pressure is generated so that a net upward force is applied on valve 64 urging it towards its open position, as shown in FIG. 8. In such a position, the outer wall of valve 64 covers and obstructs end 68*a* of each air inlet channel 68, inter alia air channelled through air inlet channel 68 from main chamber 38 to closure chamber 53 to escape from air outlet channels 49, to substantially prevent undesirable waste of pressurized air. Consequently, since valve 64 is open, compressed air from main chamber 38 applies a very high downward force on piston head 94 which urges piston 92 downwardly from its retracted limit position towards its deployed limit position, and thus a massive amount of compressed air fills the inner chamber of cylinder 82 above piston head 94, as suggested by arrows B in FIG. 9. When piston 92 is being forcibly and rapidly urged towards its deployed limit position, air located beneath piston head 94 will be forced outside of cylinder 82 through holes 84 and 85, to accumulate into annular auxiliary chamber 90 as suggested by arrows C and D in FIG. 9. The compressed air into annular chamber 90 will serve to return piston 92 to its initial, upper position, as later described.

This downward motion of piston 92 causes plunger 28 to shoot out of housing 32, through guide ring 96 and guide hole 25, and sweep notch 27 of launch plate 26, in which is nested one cleat from the cleat strip loaded in magazine 24. This sweeping of notch 27 causes the cleat nested therein to be discharged from tool 20, driven through the hardwood plank subjacent to the shoe 29 and into the subfloor being worked on.

When piston 92 is in its deployed limit position, piston head 94 is positioned beneath escape holes 84, compressed air coming from main chamber 38 and filling the inner chamber of cylinder 82 infiltrates holes 84 in order to further pressurize auxiliary chamber 90, as suggested by arrows F in FIG. 10.

Compressed air located within main chamber 38 and inside cylinder 82 apply an upward force on closure plate 70, as suggested by arrows E in FIG. 10, which results is urging the closure plate 70—air evacuation member 56—trigger 64 assembly upwardly towards its rest position.

When air evacuation member 56 reaches its rest position, fluid communication between closure chamber 53 and the atmosphere through air outlet channels 49 is interrupted, and closure chamber 53 starts to fill up with air flowing in through closure channels 80 from main chamber 38. Valve 64 consequently starts to move downwardly towards its closed position. As soon as valve 64 starts to move, end 68*b* of each air inlet channels 68*b* becomes uncovered by the side wall of valve upper portion 64*a*, thus re-establishing fluid communication between main chamber 38 and closure chamber 53. Therefore, compressed air starts to flow into closure chamber 53 also through air inlet channels 68, thus accelerating the re-pressurizing of closure chamber 53 and thereby accelerating displacement of valve 64 towards its closed position.

Figure 11:
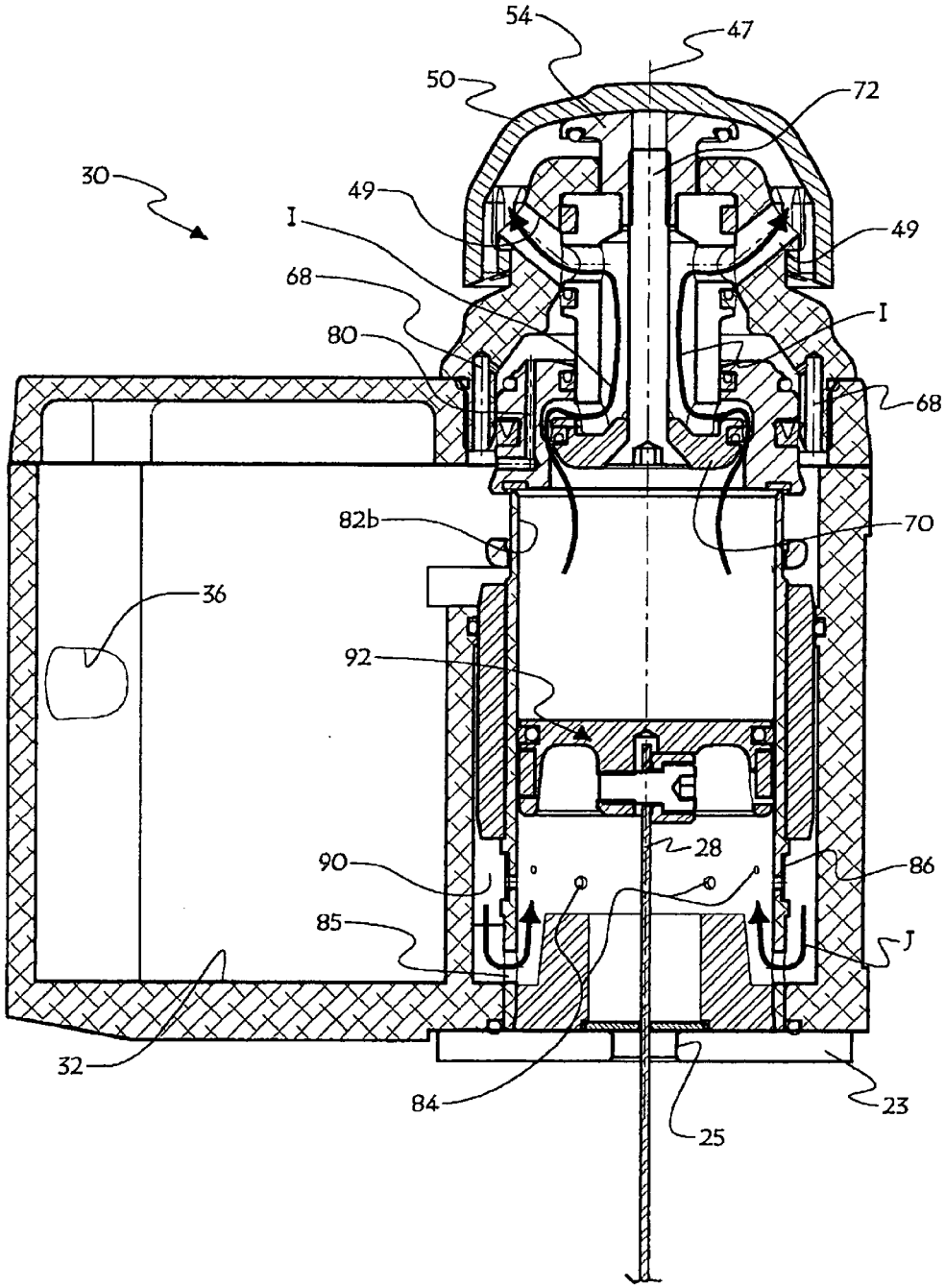

Once valve 64 is closed, the relative position of closure plate 70 and valve inner cavity 74 is such that U-cup 73 no longer provides airtight engagement therebetween, and the compressed air located in cylinder 82 above piston 92 is evacuated into the atmosphere through notches 62, air evacuation chamber 58, and out of air outlet channels 49, as suggested by arrows I in FIG. 11. The pressure above piston head 94 having thereby dropped, no resistance will longer stop the compressed air previously forced into auxiliary chamber 90 to relax and spread throughout cylinder 82, by being injected through holes 85 beneath piston head 94, as suggested by arrows J in both FIGS. 11 and 12. Therefore, this depressurizing of auxiliary chamber 90 will thus allow for piston 92 to spring back to its initial, retracted limit position, as illustrated in FIG. 12.

Thereafter, once piston 92 has returned to its retracted limit position, residual pressurized air located in cylinder 92 beneath piston head 94 leaks out in controlled fashion through the interstice between plunger 28 and guide ring 96 (as illustrated by arrows K is FIG. 12) and the inner chamber of cylinder 92 returns progressively to atmospheric pressure, whereas air chamber 53 is once again brought to the same overpressure level than main chamber 38. Tool 20 is then ready for a new nailing cycle.

An important feature of the tool of the present invention is the fact that the closing movement of valve 64, i.e. when a pressure difference on both sides thereof urges it from its open position towards its closed position, is not constant and is achieved in two parts. Firstly, when the valve 64 is in its open position and just after air evacuation member 56 has moved back to its initial rest position so as to pneumatically isolate closure chamber 53 from the atmosphere, compressed air is admitted in closure chamber 53, to initiate movement of valve 64 towards its closed position, from main chamber 38 exclusively through closure channels 80 since air inlet channels 68 are obstructed by the peripheral wall of the valve. Secondly, as valve 64 starts to move towards its closed position, its peripheral wall progressively clears each air inlet channel end 68*b*, and compressed air starts to flow towards closure chamber 53 through air inlet channels 68 as well, which will allow closure chamber 53 to become pressurized faster, thus permitting prompt displacement of valve 64 towards its closed position. With such variable speed displacement of valve 64, the time before piston 92 can return to its initial position is reduced, and so is the reload speed of tool 20.

By modifying the amount of closure channels 80 made in valve 64, and/or their shape, and/or other characteristics thereof, the rate of the initiation of the movement of valve 64 from its open towards its closed position can be adjusted. Hence, modifications only have to be done to these channels to modify the closure speed of valve 64 and the reload speed of the tool.

Accordingly, 30 to 50% less compressed air supply volume is required for proper operation of tool 20, thus reducing operation costs of the tool 20 in both overhead (size of compressed air pump) and variable costs (electricity for operating the compression pump).

In the embodiment shown in the figures, the optional O-ring 76 aids in preventing air flow towards closure chamber 53 through air inlet channels 68 when valve 64 is open. Still another alternate functional embodiments of tool 20 could be envisioned where valve 64 is deprived from such an O-ring 76, since the peripheral wall of valve upper portion 64*a* has a transverse projection 276 (FIG. 4) which may be sized and shaped to snugly penetrate and sealingly engage and obstruct inlet channel end 80*a* sufficiently so as to substantially prevent air to flow therethrough towards closure chamber 53 when valve 64 is open; however, with this latter embodiment, reinforcing tolerances must be tight.

In the embodiment of the invention, U-cup 78 establishes airtight engagement of the peripheral wall of valve 64 to the peripheral wall of head cavity 51. In another embodiment, impact receiving member 46 is deprived from such a U-cup, and head member 48 is deprived from air inlet channels 68. In this embodiment, the re-pressurizing of closure chamber 53, necessary to bias valve 64 towards its closed position after a nailing stroke, is accomplished as compressed air permeates towards closure chamber 53 from main chamber 38 through the interstice formed between the peripheral wall of valve 64 and the peripheral wall of head cavity 51, instead of passing through air inlet channels 68. In yet another embodiment where head member 48 comprises air inlet channels 68 and impact receiving member is deprived from a U-cup such as U-cup 78, compressed air could permeate both through air inlet channels 68 and the interstice formed between the peripheral wall of valve 64 and the peripheral wall of head cavity 51 to re-pressurize closure chamber 53.

It is to be noted that although the present tool is described for use with a conventional continuous air supply, it could be adapted for use with lever actuated manual release controlled air supply types of pneumatic nailing tools.

Impact receiving member 46 screwable onto and detachable from main housing 32 is the preferred embodiment. However, adapting the present invention to a standard fixed head such as one disclosed in U.S. Pat. No. 4,907,730 should be considered within the scope of the present invention.

Main use of the present invention is directed toward installation of hardwood flooring. However, other applications are deemed within the scope of this invention, in particular, nailing softwood (e.g. pine tree) floorings of the tongue-and-groove interconnection type, or installation of panelling elements or of outdoor decking. Therefore, the present invention is directed to any pneumatic tool triggered by a hammer blow.

What is claimed is:

1. A compressed fluid operated fastener driving tool, which can be selectively triggered for driving fasteners into an underlying workpiece, said tool comprising a frame, a fastener feeder for feeding fasteners to a fastener discharge mechanism of said driving tool, said fastener driving mechanism capable of shifting between a rest and an operative condition, said fastener discharge mechanism comprising:

a housing, comprising:

a first chamber having a fluid inlet destined to be connected to a source of compressed fluid for keeping said first chamber pressurized, a second chamber, comprising first and second fluid inlet ports for admitting compressed fluid from said first chamber into said second chamber, said second fluid inlet port capable of being selectively opened and closed, said second chamber being selectively depressurizable, said second chamber being pressurized when said fastener discharge mechanism is in said rest condition;

a third chamber, comprising a piston slidably mounted therein, said piston comprising a piston head and a plunger downwardly depending from said piston head, wherein said piston is biased from a first limit position towards a second limit position when said third chamber is in fluid communication with said first chamber, said piston being in said first limit position when said fastener discharge mechanism is in said rest condition;

a valve controlling fluid communication between said first chamber and said third chamber, said valve being biased towards an open limit position when said second chamber is depressurized where fluid communication is established between said first and said third chamber, and said valve being biased towards a closed limit position when said second chamber is pressurized where fluid communication is interrupted between said first and said third chamber;

wherein after said tool is triggered, said fastener discharge mechanism passes from said rest condition to said operative condition, said second chamber is depressurized to induce movement in said valve towards said open position, wherein when said valve is moved towards said open limit position, said second chamber second fluid inlet port is closed, and fluid communication is established between said first chamber and said third chamber, thus urging said piston towards said second limit position for allowing a fastener to be struck by said plunger and thus discharged from said tool; and wherein after said piston is moved towards said second limit position, fluid flowing into said second chamber through said first fluid inlet port pressurizes same and initiates movement of said valve towards said closed limit position, and wherein after initiation of movement of said valve towards said closed limit position, said second fluid inlet port is opened to accelerate pressurizing of said second chamber and thus accelerate movement of said valve towards said closed limit position.

2. A compressed fluid operated fastener driving tool according to claim 1, wherein said second fluid inlet port is closed by being obstructed by said valve when latter is in said open limit position, and wherein said second fluid inlet port is opened when it is cleared by said valve after initiation of the movement of said valve from said opened limit position towards said closed limit position.

3. A compressed fluid operated fastener driving tool according to claim 1, wherein said fastener discharge mechanism comprises an impact receiving member, and said impact receiving member has to be struck to pass said fastener discharge mechanism from said rest condition to said operative condition.

4. A compressed fluid operated fastener driving tool according to claim 3, wherein said impact receiving member comprises a hollow head member, comprising said second chamber therein.

5. A compressed fluid operated fastener driving tool according to claim 4, wherein said head member comprises at least one air outlet channel made therein, opening into said second chamber at a first end, and into an atmospheric pressure fluid volume at a second end, and wherein said second chamber can be selectively depressurized upon selective establishment of fluid communication between said second chamber and said air outlet channel second end.

6. A compressed fluid operated fastener driving tool according to claim 5, wherein a peripheral wall of said valve snugly and slidably engages a peripheral wall of said second chamber, said valve is slidable about said second chamber, wherein said valve is slid away from said second chamber when said valve is in said closed limit position, wherein said valve is slid towards said second chamber when said valve is in said open limit position.

7. A compressed fluid operated fastener driving tool according to claim 6, wherein said second chamber first fluid inlet port is formed by at least one first inlet channel made in said valve, opening at a first end into said main chamber, and opening at another end into said second chamber, and said second chamber second fluid inlet port is formed by at least one second inlet channel made in said head member, opening at a first end into said main chamber, and opening at a second end into said second chamber, and wherein said valve peripheral wall obstructs said second inlet channel second end when said valve is in said open limit position, and wherein said second fluid inlet port is opened when said valve is not in said closed limit position.

8. A compressed fluid operated fastener driving tool according to claim 3,
wherein a shock absorbing cap is fitted on said head member.

9. A compressed fluid operated fastener driving tool according to claim 1,
further comprising means for biasing said piston towards said first limit position when said valve is in said closed position.

10. A compressed fluid operated fastener driving tool according to claim 1,
wherein said third chamber is a cylinder.

11. A method for discharging a fastener out of a pneumatic fastener driving tool comprising a fastener feeder for feeding fasteners to a fastener discharge mechanism, which can be triggered to pass from a rest condition to an operative condition, and which comprises a housing having a pressurized first chamber, a selectively depressurizable second chamber comprising a first fluid inlet port and a selectively closable second fluid inlet port, said second fluid inlet port being open and said second chamber being pressurized when said tool is in said rest condition, and a third chamber in which a piston having a plunger is slidably mounted, said piston being movable between retracted and deployed limit positions and being biased towards said deployed limit position when fluid communication between said first and said third chambers is established, a valve being further nested within said housing and permitting selective establishment of fluid communication between said first and said third chamber, said method comprising the steps of:

(h) triggering said fastener discharge mechanism to pass it in said operative condition;

(i) depressurizing said second chamber and closing said second fluid inlet port thereof;

(j) since said second chamber is depressurized, displacing said valve towards said open position to establish fluid communication between said first and said third chambers;

(k) displacing said piston towards said deployed limit position;

(l) striking a fastener with said plunger to discharge a fastener from said tool;

(m) admitting compressed fluid into said second chamber from said first chamber through said first fluid inlet port to pressurize said second chamber and thus initiate movement of said valve towards said closed position; and (n) once movement of said valve is initiated, opening said second fluid inlet port to further admit compressed fluid into said second chamber, to further pressurize the latter and accelerate displacement of said valve towards said closed position.

12. A method according to claim 11,
further comprising the step, after step (g), of biasing said piston towards said retracted limit position.

13. A pneumatic nailer for use with floor securing cleats in working in hard to reach floor areas, said nailer comprising a main frame, a first air chamber, a second air chamber, a piston member reciprocatingly movable through said second air chamber, said piston member defining a plunger having at a bottom end a striker head for striking and ejecting selected floor securing cleats in successive reciprocating cycles with the cleats located outwardly of said second air chamber, and at a top end a piston head, wherein said second air chamber forms an upper subchamber and a lower subchamber on opposite sides of said piston head in substantially airtight fashion relative to one another wherein said upper subchamber and said lower subchamber are of complementarily inversely variable volume, said upper subchamber in fluid communication with said first air chamber, a third air chamber in fluid communication with said lower subchamber, first valve means controlling air flow from said first air chamber to said upper subchamber, said first air chamber adapted to contain continuous over atmospheric air pressure level thereinto, unidirectional second valve means controlling air flow from said lower subchamber to said third air chamber, first channel means for through air flow between said lower subchamber and said third air chamber responsively to an air pressure differential therebetween, and trigger means for releasably moving said first valve means from a closed condition to an opened condition enabling air flow from said first air chamber to said upper subchamber, wherein said first valve means includes means to adjust the duration of each of said reciprocating cycles of said piston member.

14. A pneumatic nailer as in claim 13,
further including a guide member, mounted to said main frame and opening into said lower subchamber of said second air chamber, said guide member including a central slit slidingly engaged by said plunger for guiding motion of said plunger during said reciprocating cycles thereof.

15. A pneumatic nailer as in claim 14,
wherein said second air chamber defines a peripheral wall section having an inner wall, slidingly engaged by said piston head, and an outer wall, a first series of registering access bores made into said wall section and opening into said third air chamber, and said second valve means consists of an elastic band applied against said second air chamber outer wall in releasable sealing register with said access bores of said wall section of said second air chamber.

16. A pneumatic nailer as in claim 15,
wherein the material nature of said guide ring member and the size of said guide ring member central slit relative to the section of said plunger slidingly engaging through said slit, are such that any overpressure inside said lower subchamber will be allowed to outwardly leak at a controlled rate through said slit toward ambient air.

17. A pneumatic nailer as in claim 16,
wherein said trigger means includes an anvil member having an outer exposed section and an inner section, said anvil member movably mounted to said main frame between an extended position and a retracted position, a fourth air chamber in fluid communication with said first air chamber through a fluid passageway, and third valve means opening said fluid passageway at said extended position of said anvil member and closing said fluid passageway at said retracted position of said anvil member, and air outlet means providing air outflow from said fourth air chamber after said anvil member leaves said extended position thereof;
wherein said air outflow from said air outlet means provides the biasing means that biases said first valve means to move from its said closed condition to its said opened condition.

18. A pneumatic nailer as in claim 17,
further including a combined screw mount assembly for releasably screwing said trigger means and said first valve means to said main frame, for facilitating manual access to said second air chamber and to said piston head for maintenance purposes.

19. A pneumatic nailer as in claim 18, further including a damper cover, mounted to said exposed section of said anvil member, said damper cover made from a shock absorbing material.

20. A pneumatic nailer as in claim 14, wherein said trigger means and said first valve means are mounted in a screwtube releasably screwable into a threaded access bore in said main frame.

* * * * *